US005450277A

United States Patent [19]

Wescott et al.

[11] Patent Number: 5,450,277

[45] Date of Patent: Sep. 12, 1995

[54] DEVICE FOR DISCHARGING ELECTROSTATIC ENERGY

[75] Inventors: M. Elizabeth Wescott, Windsor; Michael D. Temple, Santa Rosa, both of Calif.

[73] Assignee: Optical Coating Laboratory, Inc., Santa Rosa, Calif.

[21] Appl. No.: 367,918

[22] Filed: Jan. 3, 1995

Related U.S. Application Data

[63] Continuation of Ser. No. 27,738, Mar. 8, 1993, abandoned.

[51] Int. Cl.[6] ..... H05F 3/02

[52] U.S. Cl. ..... 361/220; 361/212; 340/649

[58] Field of Search ..... 307/91; 361/212–224; 174/556; 340/635, 649, 650, 662, 815.4

[56] References Cited

U.S. PATENT DOCUMENTS

| | | | |
|---|---|---|---|
| 2,475,356 | 7/1949 | Meschter | 361/212 |
| 3,094,436 | 6/1963 | Schröder | 361/212 X |
| 3,745,412 | 7/1973 | Ruff | 361/220 |
| 3,780,345 | 12/1973 | Earman, Jr. | 361/220 |
| 4,313,148 | 1/1982 | Turner | 361/212 |
| 4,468,702 | 8/1984 | Jandrell | 358/245 |
| 4,586,106 | 4/1986 | Frazier | 361/212 |
| 4,654,746 | 3/1987 | Lewis, Jr. et al. | 361/212 |
| 4,745,517 | 5/1988 | Pitts | 361/212 |
| 4,745,518 | 5/1988 | Fang | 361/220 |
| 4,747,674 | 5/1988 | Butterfield et al. | 361/220 X |
| 5,222,013 | 6/1993 | Schwalm | 361/212 |
| 5,359,319 | 10/1994 | Campbell et al. | 340/649 |

FOREIGN PATENT DOCUMENTS

| | | | |
|---|---|---|---|
| 0285103 | 10/1988 | European Pat. Off. . | |
| 2133935 | 8/1984 | United Kingdom | 361/212 |
| WO9310650 | 5/1993 | WIPO . | |

OTHER PUBLICATIONS

Kawamura et al, "Transparent plastics: provision for surface conductivity," Revue Generale de L'Electricite, No. 2, Feb. 1987, pp. 39–44.

Brochure, OCLI Glareguard anti-glare screen with static electricity discharge ground lead, 1991.

Brochure, Pental Static Electricity Remover combination key chain and static electricity discharge device, no publication date.

Brochure, Stat-Tech International Corporation Static Buster Model 201 static electricity discharge device, no publication date.

"Trying to Assess the Potential Hazards of Video Terminals"; Peter H. Lewis; New York Times article; Apr. 21, 1991.

IBM Technical Disclosure Bulletin, vol. 20 No. 12 May 1978, H. L. Rowe, p. 5353.

*Primary Examiner*—A. D. Pellinen
*Assistant Examiner*—Fritz M. Fleming
*Attorney, Agent, or Firm*—Philip A. Dalton

[57] ABSTRACT

An electrostatic discharge device painlessly discharges electrostatic energy from a computer operator and/or an optical element such as a filter mounted on a cathode ray tube (CRT) computer monitor. The electrostatic discharge device preferably is mounted on the frame of the optical filter, and includes an electrostatic discharge pad circuit which includes a discharge pad comprising a substrate coated with a conductive material and connected to ground. A person such as a computer operator who contacts the coated substrate is discharged of any electrostatic charge through the coated substrate, to ground. A display to indicate the discharge can be connected between the discharge pad and ground and in parallel with a resistor to control the rate of discharge through the display. The device also includes an electrostatic field drain circuit for discharging electrostatic energy emanating from the face of a CRT monitor. The field drain includes a transparent, electrically conductive coating which is formed on the face of the optical filter and is connected to an input terminal of a display, the output terminal of which is connected to ground. Electrostatic charge emitted from the monitor and deposited on the filter is transmitted through the display, which indicates the discharge, to ground.

12 Claims, 2 Drawing Sheets

DEVICE FOR DISCHARGING ELECTROSTATIC ENERGY

This is a continuation of application Ser. No. 08/027738, filed Mar. 8, 1993.

FIELD OF THE INVENTION

The present invention relates to an electrostatic discharge device and, in particular, to the design and fabrication of a device for discharging electrostatic energy, for example, from computer operators and/or an object (e.g. optical element) that is in the electrostatic field emitted from a cathode ray tube (CRT) monitor.

DESCRIPTION OF THE RELATED TECHNOLOGY

Increased miniaturization and device densities in integrated circuit chips have been accompanied by an increased sensitivity to electrostatic energy. A computer operator who is electrostatically charged (for example, by frictional contact with a carpet) and directly or indirectly contacts an integrated circuit (via the case of a computer) can damage that integrated circuit through the mechanism of electrostatic discharge. In addition, electrostatic discharge can be painful.

Existing devices for discharging electrostatic energy do not eliminate the problem of shocks. Furthermore, some existing devices do not provide a feedback mechanism to indicate to an operator that electrostatic discharge is occurring. Without feedback, the operator does not know whether the discharge device is working, and whether she or he has been fully discharged.

In view of the above problems, one object of our invention is to painlessly discharge electrostatic energy from a person, such as a computer operator.

Other objects of the invention, not exhaustive, are to discharge electrostatic energy from an object such as an optical element, for example an optical filter, mounted in front of the face of a CRT monitor; to indicate the discharge of electrostatic energy; and to control the time required to discharge electrostatic energy.

SUMMARY OF THE INVENTION

According to the present invention, the foregoing and other objects are attained in an electrostatic discharge device which is adapted for mounting on a video display terminal and which comprises a touch pad or discharge pad in the form of a substrate and a coating, formed on the substrate, which has a surface resistivity between about 10 megohms per square and about 100 megohms per square and is connected to ground. The electrostatic charge on a body such as a person or object which contacts the discharge pad is conducted from the coated substrate, which controls the rate of discharge of the object, to ground. In another embodiment, the device comprises a display, which is connected between the coated substrate and ground, for indicating the electrostatic discharge through the device, and is connected in parallel with a resistor, for controlling the rate of electrostatic discharge through the display.

In accordance with yet another aspect of the invention, our device is adapted for mounting on a video display terminal for discharging electrostatic energy from an object such as a human body, and from an optical element such as an anti-glare screen mounted proximate the viewing surface of a cathode ray tube monitor. The device comprises a substrate; a coating formed on the substrate, which has a surface resistivity between about 10 megohms per square and about 100 megohms per square; a display which has two input terminals and at least one output terminal, for indicating the electrostatic discharge through the device; and a resistor connected in parallel with one of the input terminals and the output terminal of the display means. The second input terminal of the display means is connected to an electrically conductive optical filter which preferably is mounted on the front side of the viewing surface of the monitor. The electrostatic charge on an object which contacts the coated substrate and/or the electrostatic charge emitted from the viewing surface of a CRT monitor and deposited on the optical filter are dissipated to ground, while the display means indicates the electrostatic discharge.

Our as-claimed device rapdily discharges electrostatic energy without shock. In the embodiments having a display, our device visually indicates the discharge of a body, such as a human being and/or an optical element such as an anti-glare screen, thereby ensuring to the operator's satisfaction that the person has been discharged and/or that the optical element is being continuously discharged.

BRIEF DESCRIPTION OF THE DRAWING

The above and other aspects of the invention are described with respect to the drawing, in which.

DETAILED DESCRIPTION OF THE PREFERRED EMBODIMENT(S)

Figure 1:
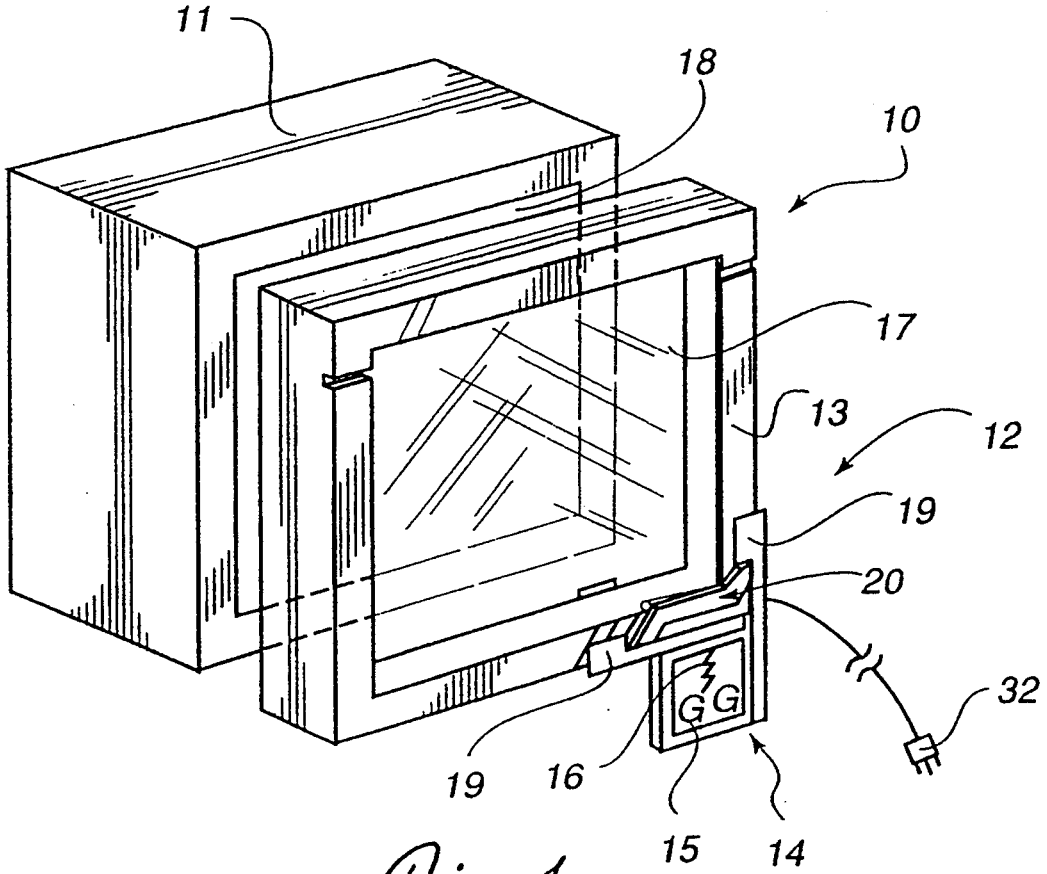
FIG. 1 is a partially exploded perspective view of an optical element which is mounted on a cathode ray tube monitor that incorporates the electrostatic discharge device of our invention.

FIG. 1 is a partially exploded perspective view illustrating an optical device 10 such as an anti-glare filter which incorporates our invention, and the mounting of the improved device 10 on a cathode ray tube (CRT) monitor 11. The exemplary CRT monitor 11 includes a face or screen 18. The optical device includes a bezel 13 which supports a screen or plate 17. In one embodiment, the device 10 is a GLARE-GUARD anti-glare filter, available from the assignee, which incorporates a plate 17 that is coated with conductive optical thin film coatings for reducing light reflection/glare. As described more fully below, an eLectrostatic discharge device 12 is incorporated integrally into (or mounted on) the filter 10 and (1) continuously discharges the electrostatic charge generated by the monitor 11 and deposited on the screen 17 and/or discharges electrostatic charge on a body such as the operator of the monitor when the operator contacts the touch or discharge pad 20 and (2) indicates the discharge operation(s).

The electrostatic discharge device 12 includes an LCD display 14 which preferably incorporates or mounts substantially all the removable elements of the electrostatic discharge circuits, such as the discharge pad 20 and ground plug 32. The ground plug is connected to the display 14 and preferably comprises two dummy prongs and an active ground prong for convenient insertion into an ordinary three-pronged electrical outlet for safely discharging the electrostatic charge to ground. In the embodiment shown in FIG. 1, the LCD display 14 comprises a pair of icons 15 and 16 which indicate the operation of the circuit 12 in discharging electrostatic charge from the screen 17 (that is, the charge deposited on the screen by the monitor) and from the discharge pad 20 (the charge on the operator). Please note, the term "icon" is used throughout this application to represent an icon and/or one or more elements of an LCD.

The electrostatic discharge device 12 is shown mounted to, but alternatively can be formed integrally with, the bezel 13 of the optical filter 10. In the embodiment depicted in FIG. 1, the electrostatic discharge device 12 includes clamping devices 19—19 for mounting the discharge device 12 to the bezel of the optical filter 10. The clamping devices 19—19 can be the compression clamps disclosed in commonly-assigned patent application U.S. Ser. No. 07/724,427, filed Jul. 3, 1991, for releasably mounting the combined pad and drain device 12 to the bezel 13, thereby permitting replacement and transfer of the device. Alternatively, other attachment means such as screws can be used.

Figure 2:
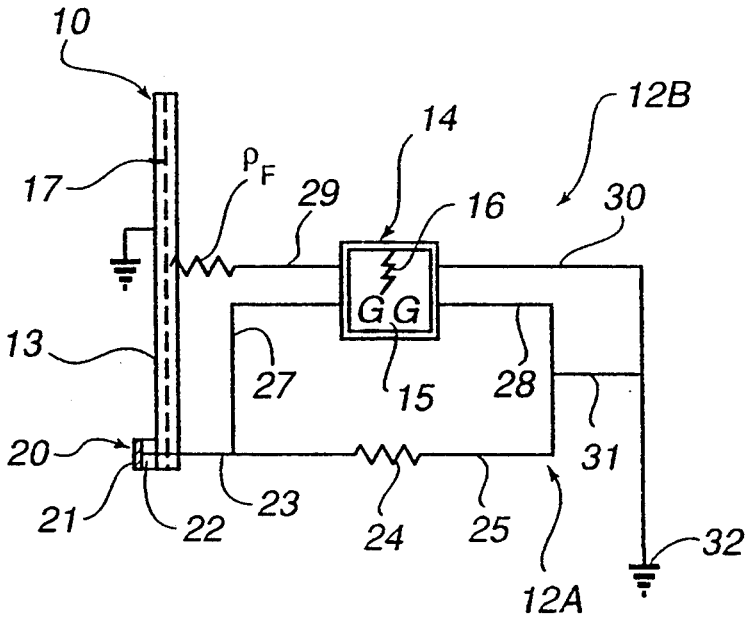
FIG. 2 schematically depicts the circuit aspects of the filter of FIG. 1.

Refer now to both FIG. 1 and FIG. 2 to consider the electrostatic discharge device 12 in detail. The latter figure is a circuit schematic illustrating the relationship of the various elements of our electrostatic discharge device 12 to the optical device 10. As alluded to previously, the electrostatic discharge device 12 includes an electrostatic discharge pad circuit 12A and an electrostatic field drain circuit 12B. The electrostatic discharge pad circuit 12A discharges to ground 32 electrostatic charge from animate and inanimate objects which contact, or approach, the discharge pad 20. In the illustrated embodiment, the LCD display 14 indicates the discharge, preferably by displaying an icon 15. The electrostatic field drain circuit 12B discharges to ground electrostatic energy on the face 17 of the conductive optical filter 10. Icon 16 of the LCD 14 indicates the discharge.

Referring primarily to FIG. 2 and to the electrostatic discharge pad circuit 12A shown therein, preferably the discharge pad 20 comprises an electrically non-conductive substrate 22 and a conductive coating 21 formed on the substrate to provide surface conductivity. In the illustrated embodiment, the substrate 22 (see FIG. 1) is the corner clip which is disclosed in commonly-assigned patent application U.S. Ser. No. 07/771,270, filed Oct. 4, 1991. The discharge pad 20 is mounted on the filter bezel 13 and is connected by a conductor such as 23 to resistor 24, which in turn is connected by conductor 25 and suitable additional conductors such as 31, as required, to the ground plug 32 (or other suitable ground connection). LCD 14, specifically, icon 15, is connected in parallel with, and to the opposite sides of, resistor 24 by conductors such as 27 and 28. (Please note, as used here, "conductor" means any suitable electrically conductive member, such as a wire, wiring harness, printed circuit, conductive layer, etc.) The charge of an electrostatically charged object that contacts the coating 20 is conducted through the resistor 24 and LCD 14 to ground, activating the icon while the charge is being dissipated. When the object is discharged, the LCD 14 ceases to visually display the icon 15.

Preferably, the substrate is high impact polystyrene material and the substrate coating 21 is non-hygroscopic, so that its discharge operation does not require water vapor in the ambient atmosphere and will not be adversely affected by moisture. The resistivity $\rho_c$ of the coating 21 preferably is within the range of about 10 megohms per square to about 100 megohms per square, to prevent the sensation of being shocked which is usually associated with an electrostatic discharge, and to ensure a high rate of discharge. One such coating material which has these preferred properties is tin oxide doped with antimony in a polymer base. Preferably, the resistance $R_p$ of the resistor 24 is about 22 megohms, to ensure a painless high rate of discharge of the electrostatic charge through the LCD 14.

Alternatively, an audible indicating device, such as a buzzer, can be connected in parallel with the resistor, alone, or in combination with the LCD or other type of display, to indicate the electrostatic discharge operation audibly and/or visually.

The field drain circuit 12B discharges electrostatic energy which is emitted by the face of the CRT monitor 11 (see FIG. 1) onto the face 17 of optical filter 10. To ensure the conduction of electrostatic charge from the optical filter 10 to ground 32, and thus the proper operation of the electrostatic discharge circuit 12B, without degrading viewing through the filter 10, the face 17 of the filter is coated with transparent, electrically conductive material. For this purpose, preferably the resistivity $\rho_F$ of the transparent coating 17 is less than about 7 kilohms per square. A preferred material for this coating is indium tin oxide. In the embodiment depicted in FIGS. 1 and 2, the conductive transparent coating on filter face 17 is electrically connected via conductor 29 to one input terminal of the LCD 14. The corresponding output terminal of the LCD 14 is electrically connected via conductor 30 to ground 32. When the filter 10 becomes electrostatically charged, the charge is conducted through the LCD 14 and then to ground. The discharge current through the LCD 14 activates icon 16 of the LCD 14, thereby indicating that the field drain circuit 12B is operating.

As discussed above with respect to the electrostatic discharge pad 12A, an audible indicating device can be used in the field drain circuit 12B in place of, or in combination with, the LCD or other visual displays.

Figure 3:
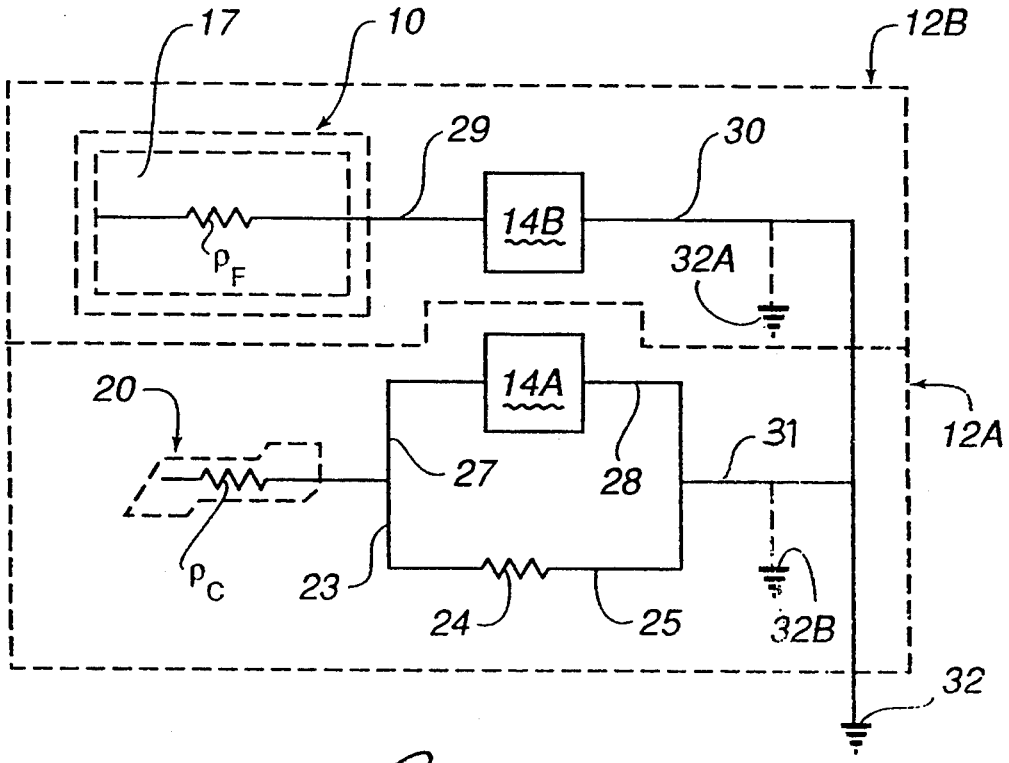
FIG. 3 is an electrical circuit diagram illustrating the electrostatic discharge device as two separate units: an electrostatic field drain circuit, and an electrostatic discharge pad circuit.

FIG. 3 depicts an alternative embodiment of our electrostatic discharge circuit 12 comprising separate LCD devices 14A and 14B for the discharge pad circuit 12A and the separate field drain circuit 12B, respectively. Alternatively, as shown in phantom, separate ground plugs/connectors 32A and 32B may be used for each of the circuits. Operation of the circuit is the same as discussed relative to FIG. 2 (with the exception that the individual LCD's 14A and 14B replace the icons 15 and 16 of the LCD 14.)

Based upon the preferred and alternative embodiments of our invention described here, those of usual skill in the art will readily adapt, modify and extend the devices described here in a manner within the scope of the following claims.

We claim:

1. A device for discharging electrostatic energy from a body, comprising:

a discharge pad, comprising a substrate and a non-hygroscopic coating formed on the substrate and connected to ground, the coating having a surface resistivity between about 10 megohms per square and about 100 megohms per square for conducting electrostatic charge on a body proximate to or contacting the coating;

indicator means connected between the discharge pad and ground, for indicating the electrostatic discharge through the device; and resistor means connected in parallel with the indicator means, for controlling the rate of electrostatic discharge through the indicator means;

whereby the electrostatic charge of a body which contacts the discharge pad is conducted from the discharge pad in controlled fashion to ground and the controlled discharge is indicated by the indicator means.

2. The device of claim 1, wherein the indicator means is an optical display.

3. The device of claim 1, wherein the resistance of the resistor means is about 22 megohms.

4. A device for discharging electrostatic energy from a body, comprising:

a discharge pad comprising a substrate and a conductive coating formed on the substrate for conducting electrostatic charge on a body proximate to or contacting the coating;

display means for indicating the electrostatic discharge through the device; and resistor means connected in parallel with the display means, and connected on one side to the substrate, and on the opposite side to ground, for controlling the rate of electrostatic discharge through the display means;

whereby electrostatic charge of a body which is moved in proximity to or contacts the coating of the discharge pad is conducted through the substrate, to the display means, which indicates the electrostatic discharge through the device, and the resistor means, to ground.

5. The device of claim 4, wherein the substrate coating is non-hygroscopic and the surface resistivity of the coating is between about 10 megohms per square and about 100 megohms per square.

6. The device of claim 5, wherein the resistance of the resistor means is about 22 megohms.

7. A device adapted for mounting on a video display terminal for discharging electrostatic energy from a body, and discharging electrostatic energy emanating from a monitor of the video display terminal, comprising:

an optical element adapted for mounting in front of the viewing surface of the monitor, the optical element comprising a face having a conductive optical coating formed thereon;

a discharge pad comprising a substrate adapted for mounting on the optical element and a conductive coating formed on the substrate;

first and second display means, for indicating the electrostatic discharge through the device;

resistor means connected in parallel with a first one of the display means, between the conductive coating and ground; and the second display means being connected in series between the optical element and ground;

whereby electrostatic charge of a body which contacts the coated substrate is conducted through the conductive coating on the substrate, to the first display means, for indicating electrostatic discharge through the device, and to the resistor means, for controlling the rate of electrostatic discharge through the first display means, to ground, and whereby electrostatic charge on the face of the optical element is conducted across the second display means to ground, for discharging and indicating the electrostatic discharge of the element.

8. The electrostatic discharge device of claim 7, wherein the substrate coating is non-hygroscopic and the surface resistivity of the coating is between about 10 megohms per square and about 100 megohms per square.

9. The electrostatic discharge device of claim 7, wherein the resistance of the resistor means is about 22 megohms.

10. The electrostatic discharge device of claim 9, wherein the resistivity of the conductive optical coating on the face of the optical element is less than about 7 kilohms per square.

11. The electrostatic discharge device of claim 7, further including a display device comprising the first and second display means.

12. The electrostatic discharge device of claim 7, wherein the first and second display means are separate devices.

* * * * *